United States Patent [19]

Gale et al.

[11] Patent Number: 4,537,586

[45] Date of Patent: Aug. 27, 1985

[54] METHOD AND APPARATUS FOR APPLYING COUPON STRIPS TO PAPER BAGS

[75] Inventors: Ronald S. Gale, Beaverton; William E. Bristol, Hillsboro; Carroll Noonan, Beaverton, all of Oreg.

[73] Assignee: Willamette Industries, Inc., Beaverton, Oreg.

[21] Appl. No.: 581,547

[22] Filed: Feb. 21, 1984

[51] Int. Cl.[3] ..... B31B 1/90; B31B 37/74

[52] U.S. Cl. ..... 493/220; 493/224; 493/961

[58] Field of Search ..... 493/220, 221, 222, 224, 493/226, 933, 961

[56] References Cited

U.S. PATENT DOCUMENTS

| | | | |
|---|---|---|---|
| D. 229,896 | 1/1974 | Bemel | D9/249 |
| D. 237,780 | 11/1975 | Bemel | D9/249 |
| 1,541,167 | 6/1925 | Mulvey . | |
| 2,073,476 | 3/1937 | Grant et al. | 493/222 |
| 2,083,860 | 6/1937 | Offenbacher . | |
| 2,226,943 | 12/1940 | Poppe . | |
| 2,248,895 | 7/1941 | Parrish | 493/221 |
| 2,614,349 | 10/1952 | Barnes . | |
| 2,815,620 | 12/1957 | Prodigo . | |
| 2,917,164 | 12/1959 | Kehr . | |
| 3,155,234 | 11/1964 | Knott et al. | 206/17 |
| 3,183,614 | 5/1965 | Loderhose | 40/312 |
| 3,348,759 | 10/1967 | Johnson | 229/53 |
| 3,593,622 | 7/1971 | Sengewald | 493/226 |
| 3,804,323 | 4/1974 | Bemel | 229/53 |
| 3,929,275 | 12/1975 | Bolling et al. | 493/933 |
| 4,103,820 | 8/1978 | Mathison et al. | 229/37 R |
| 4,202,450 | 5/1980 | Howell et al. | 206/459 |

FOREIGN PATENT DOCUMENTS

| | | | |
|---|---|---|---|
| 1101199 | 3/1954 | France . | |
| 654460 | 6/1951 | United Kingdom | 493/220 |

*Primary Examiner*—Francis S. Husar
*Assistant Examiner*—William E. Terrell
*Attorney, Agent, or Firm*—Klarquist, Sparkman, Campbell, Leigh & Whinston

[57] ABSTRACT

A combination of a self-opening shopping bag and a coupon strip is disclosed together with apparatus and a method for making same. An elongated coupon strip containing coupons is affixed inside the front panel of the bag. The coupon packet is sized and positioned widthwise between the side gussets of the bag. The strip has a perforated margin portion and only the margin is adhered to the bag so that the coupons can be readily detached. The coupon-applying apparatus includes a coupon strip roll stand positioned in line with the bag paper roll stand. A glue applicator is mounted on the coupon strip roll stand for applying glue to the margin of the strip. The coupon strip meets the underside of the bag paper as the paper travels around an outfeed roller of the bag paper roll stand. The coupon roll stand includes a brake for tensioning the strip. Spacers are mounted on the former and spaced apart for the coupon strip to pass between them. The bag paper is formed into a tube enclosing the strip and protecting it during subsequent steps in the bag-making process. A metering pump is operably connected to a rotationally driven element of the bag-making machine for proportioning the discharge of glue from the glue applicator to the rate of bag production.

2 Claims, 8 Drawing Figures

FIG. 1
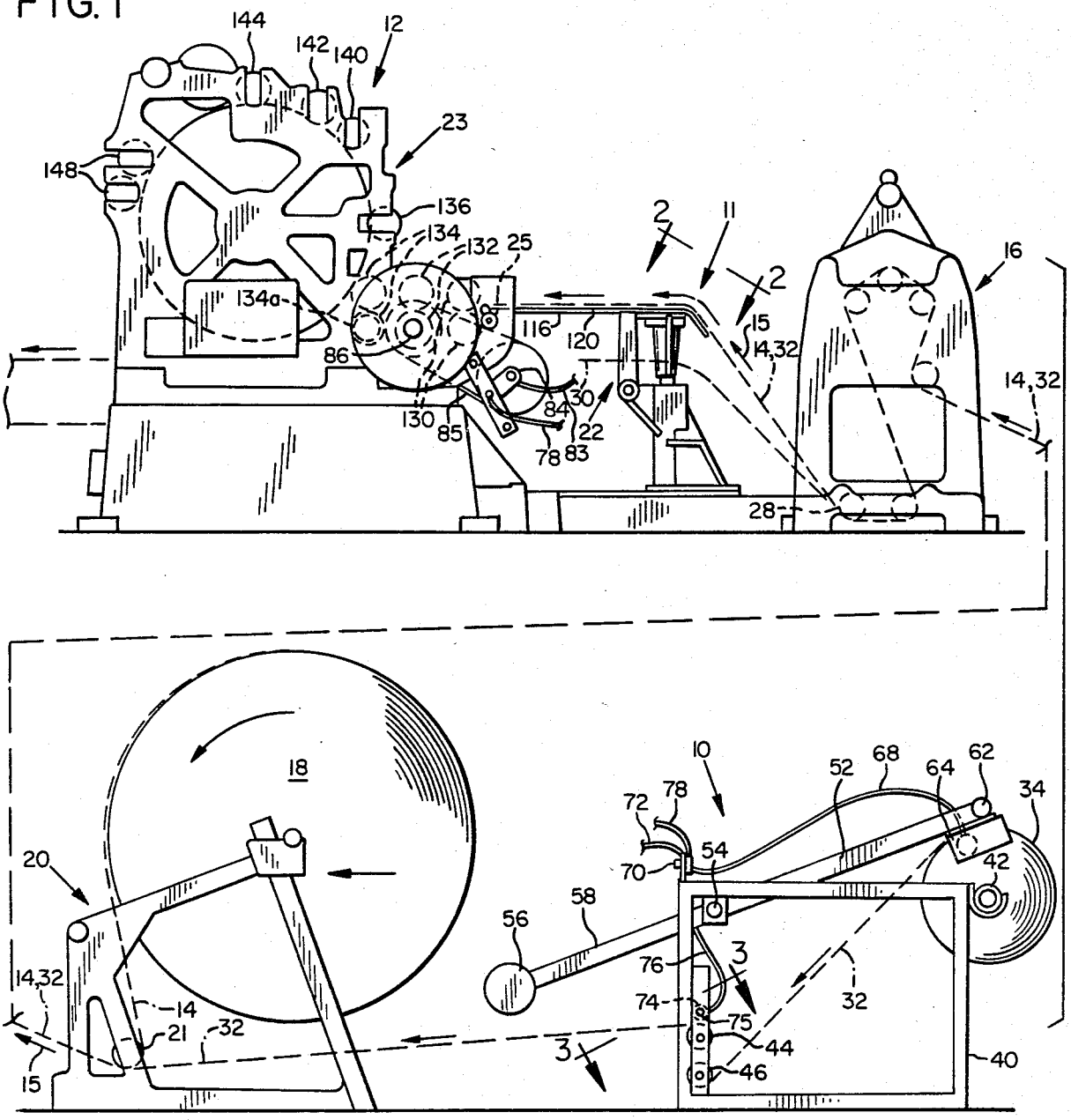
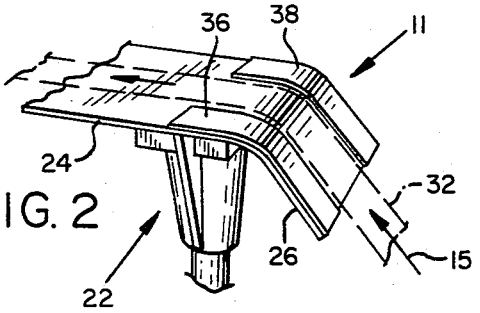
FIG. 2
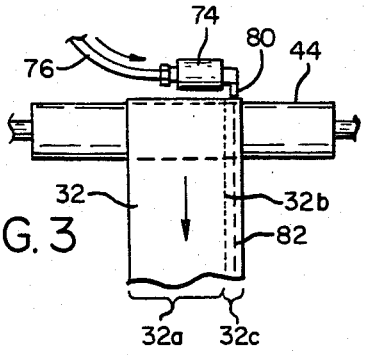
FIG. 3

METHOD AND APPARATUS FOR APPLYING COUPON STRIPS TO PAPER BAGS

BACKGROUND OF THE INVENTION

This invention relates generally to application of information-bearing labels, strips and the like to containers, and more particularly to applying detachable coupons to self-opening paper grocery bags.

It has long been recognized as desirable to be able to apply information-containing envelopes, strips and the like to containers such as bags. It has also been recognized as desirable to be able to open or remove the attached item. Several different ways of applying detachable coupons to bags have been tried. However, no practical approach has been developed for application of coupons to self-opening paper grocery bags, during manufacture, in such a way that the coupons can be readily detached by customers without damaging the bags.

U.S. Pat. No. 2,226,943 to Poppe discloses a paper bag in which a marginal portion of the bag material at the mouth of the bag is perforated for easy detachment. Such portion is imprinted as desired to provide either a coupon for customers or a customer's receipt. The form of bag used in Poppe is not a self-opening grocery bag, that is, a bag having four side panels and a bottom panel, but a pinch-bottom bag having two sides or panels connected along side and bottom edges. However, U.S. Pat. No. 3,804,323 to Bemel discloses a similarly imprinted, perforated coupon in a self-opening grocery bag. In both types of bags, the coupons can be readily imprinted during manufacture of the bags. Nevertheless, this arrangement has not proven widely acceptable in the marketplace. Customers are apparently unwilling to go to the trouble to tear off the coupons. Tearing off the coupons also damage the bags, limiting their reusability. Undamaged, the larger bags can be reused as garbage bags and the smaller bags as lunch bags.

U.S. Pat. No. 2,614,349 to Barnes discloses two-sided bags with a strip of imprinted paper, usable as a label or coupon applied to the outside of the fron panel of the bag during manufacture. U.S. Pat. No. 2,815,620 to Prodigo discloses a similar approach for applying detachable coupons to heat-sealed packages during manufacture. This approach avoids damaging the bags when the coupons are removed, but appears to be limited to pinch-bottom bags.

The shape of standard four-sided self-opening paper grocery bags, and the method and apparatus conventionally employed to make such bags, appear to preclude using the form and position of coupon strip and method of application taught by Barnes. The machinery for making self-opening bags is very complex and would likely tear off the coupon strip, with substantial risk of jamming, and possibly, damaging the machine. It is also commonplace for self-opening bags to be made with two layers of bag paper. Such bags are known as duplex bags. They are made by placing a second roll stand upstream and in alignment with a first roll stand. The two sheets of bag paper are brought together to form the two layers of bag paper. The two layers are typically run through a printer to print the outer layer. However, it is unknown to provide coupons in such bags.

The aforementioned patent to Bemel and U.S. Pat. Nos. D229,896 and D237-780 to Bemel disclose coupon packets affixed to the bottom panels of four-sided grocery bags. However, Bemel does not disclose how to apply such coupons to the bottom of bags and no method for doing so is known to exist. There is no known way of automating the application of the coupon packets to the bottoms of grocery bags. Prior attempts to devise such a method have failed. The coupon packets must therefore be applied to bags manually, an expensive, labor intensive effort. Also, applying the coupon packet to the bottom of the bag makes it very difficult to stack many of the bags when folded flat. The bags form very uneven stacks which are difficult to bind and to stack one atop another. These drawbacks virtually preclude application of the coupons during or immediately following manufacture of the bags since it makes them very difficult to ship. Moreover, the labor and expense required to manually apply the packets makes their application very impractical for either bag manufacturers or for grocers. Consequently, this manner of applying the coupons to grocery bags has not been widely accepted.

Other arrangements for applying or attaching strips or tags to bags require special construction of the bags. U.S. Pat. No. 1,541,167 to Mulvey discloses a sample-carrying packet applied to a bag. A transparent sheet overlies the sample and is attached to the bag by adhesive extending along margins of the transparent sheet. A cord is provided for tearing the transparent sheet to remove the sample. U.S. Pat. No. 2,083,860 to Offenbacher discloses a sandwich bag constructed to provide pouches in the base of the bag for carrying salt and pepper. U.S. Pat. No. 2,917,164 to Kehr, discloses a compartmented bag constructed to enclose a premium item, such as a baseball card, separately from the contents of the bag. In U.S. Pat. No. 3,348,759, Johnson discloses a specially designed paper bag in which the closure of the bag is arranged to receive the shopper's cash register receipt. None of these arrangements is desirable because each requires a special form of bag. It is preferable to be able to apply the coupons to standard four-sided self-opening paper grocery bags.

Various modes of applying tags and strips to boxes and cartons are also known. U.S. Pat. No. 3,183,614 to Loderhose discloses a cereal box having an extra flap which is perforated for easy removal and is imprinted as desired to provide a coupon or premium item. U.S. Pat. No. 4,103,820 to Mathison, et al. discloses a generally similar approach to providing a removable insert in one wall of a carton. U.S. Pat. No. 3,155,234 to Knoll, et al. discloses an arrangement for providing a packing slip packet on a package, the packing slip being contained within a transparent envelope which is perforated, or can be cut, to remove packing information. French Pat. No. 1,101,199 discloses an applique for providing descriptive information on a package. U.S. Pat. No. 4,202,450 to Howell, et al. discloses a method of incorporating labels between layers of transparent films making up a wall of a double-walled envelope or pouch. None of this group of patents suggests any better ways to provide detachable coupons on paper grocery bags.

Accordingly, a need remains for an inexpensive, convenient, and customer-acceptable way to apply coupons to self-opening grocery bags.

SUMMARY OF THE INVENTION

One object of the invention is to provide an improved mode of application of detachable coupons to grocery bags.

A second object is to provide a mode of attachment of coupons to four-sided self-opening grocery bags which can be readily automated.

A third object of the invention as aforementioned is to provide a method and apparatus for automating application of coupons to grocery bags.

A further object of the invention is to enable application of detachable coupons to self-opening grocery bags during manufacture of the bags.

Another object is to apply coupons to self-opening grocery bags in a way that does not interfere with stacking and shipping of the bags.

A first aspect of the invention is combination of a self-opening shopping bag and a coupon strip removably attached to the inside of the bag. The shopping bag has front and back panels, opposite side panels, and a bottom panel. A lap seam extends lengthwise of the bag along the back panel. Each side panel or gusset is folded inwardly along a crease to underlie the front panel and the bottom panel is folded over a lower margin of the front panel for folding the bag flat. An elongated coupon strip is affixed lengthwise inside the front panel of the bag. The coupon strip is sized and positioned widthwise between the inwardly folded sides or gussets of the bag so as not to overlap the gussets when the bag is folded flat. The coupon strip comprises a narrow lengthwise margin portion and printed coupon portion. The strip is adhered to the bag paper along only the margin portion and is perforated therealong so that the printed coupon portion can readily be detached from the bag.

A self-opening paper-bag manufacturing system is provided which includes an apparatus for applying coupon strips to the paper bags during manufacture of the bags. The bag-making system generally includes infeeding means for longitudinally infeeding a continuous flat sheet or web of bag paper and bag-making means aligned with the infeed means to receive the sheet for making bags from successive longitudinal segments thereof. The bag-making means includes a forming means offset from the infeeding means and extending longitudinally between opposite edges of the sheet for continuously folding opposite margins of the flat sheet toward one side of the sheet and connecting the margins along a seam to form the sheet into a tube. The machine also includes means rotationally driven for cutting and folding the successive paper segments into four-sided self-opening bags.

The coupon strip-applying apparatus is designed and positioned to apply the coupon strip at the beginning of the bag-making process. A coupon strip infeed means is positioned upstream of the forming means for infeeding a continuous coupon strip lengthwise onto the continuous narrow sheet of bag paper between the bag paper and the forming means. A glue applicator means is mounted between the coupon strip infeed means and the forming means for applying a strip of glue to a side of the coupon strip facing the bag paper to adhere the strip to the bag paper. Means are provided for pressing the coupon strip against the sheet of bag paper prior to entering the forming means. The pressing means preferably uses an outfeed roller in the bag paper infeed means to bring the sheet and strip together and brake means in the strip infeed means for tensioning the strip to press it against the bag paper. The continuous coupon strip is attached to a side of the bag paper so that it is enclosed within the tube. The strip is preferably positioned laterally of the continuous sheet of bag paper so that it is centered between the side panels within the bags. In this location the strip neither interferes with nor is removed by subsequent steps in the bag-making procedure. The gluing means is preferably connected to the rotationally driven means for driving the gluing means and proportioning the rate of glue discharge to the operating speed of the bag-making machine.

The foregoing apparatus thus provides one way to carry out a method of applying detachable coupon strips to grocery bags during manufacture of the bags. The method includes conveying a continuous sheet or web of bag paper and a continuous strip in the same longitudinal direction with the strip along one side of the sheet; applying glue along a side of the strip facing the sheet; pressing the strip against the sheet; and continuously turning longitudinal margins of the sheet toward said one side to form the bag paper into a tube enclosing the strip. Then, follow the steps of periodically cutting a portion of the sheet of bag paper and the coupon strip transversely to define a top of a first bag and a bottom of a second bag; folding portions of the longitudinal margins of each bag inward to form gussets in the sides of the bag; and folding the bottom of each bag to close same, thereby completing the bag with the strip affixed inside the front panel thereof. Preferably, the coupon strip is centered inside the front panel and sized so that at least the coupon portion is not overlapped by a lower end of the sides of the bag folded inwardly to form the bottom of the bag.

The coupon strip is preferably perforated along a narrow margin portion and glue is applied only to the margin portion so that the coupons can be readily separated from the bag.

The foregoing and other objects, features and advantages of the invention will become more readily apparent from the following detailed description which proceeds with reference to the accompanying drawings.

BRIEF DESCRIPTION OF THE DRAWINGS

FIG. 1 is a side elevational view of a self-opening bag-making system including apparatus in accordance with the invention for applying coupon strips to the inside of the bags during their manufacture, an infeeding sheet of bag paper and coupon strip being shown in phantom lines.

FIG. 2 is an enlarged perspective view of a portion of the former of the bag-making machine of FIG. 1, as modified to facilitate applying coupon strips in accordance with the invention.

FIG. 3 is an enlarged view of the glue applicator taken along lines 3—3 in FIG. 1.

DETAILED DESCRIPTION

Overall Arrangement

Figure 4:
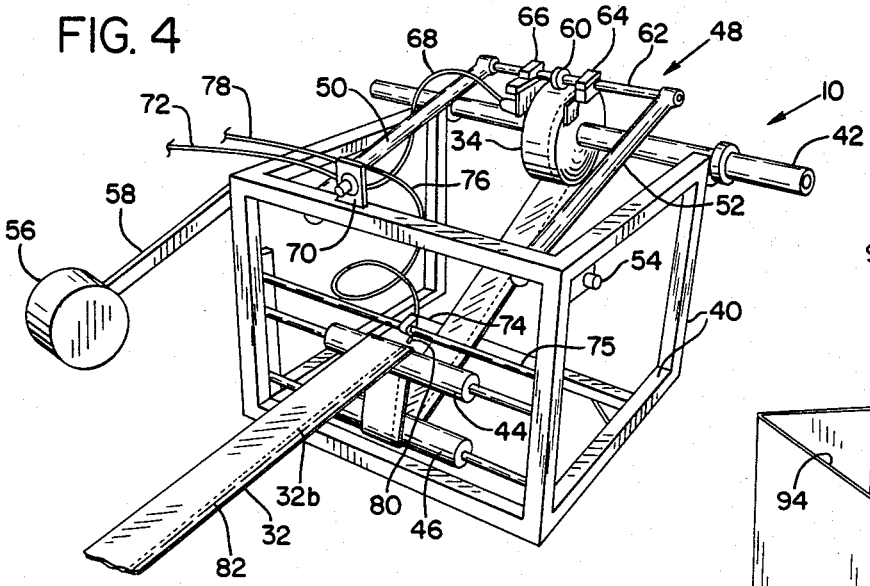
FIG. 4 is a perspective view of the coupon strip infeed apparatus of FIG. 1, as viewed from alongside the bag paper roll stand.

Referring to FIG. 1, coupon strip-applying apparatus 10, 11 is integrated into a bag-making system which includes a bag-making apparatus 12. Bag paper is infed in a continuous sheet 14 in the direction of arrows 15 along an infeed path through an imprinter 16 from a paper roll 18 supported on a roll stand 20. The illustrated imprinter 16 and roll stand 20 are conventional devices made by POTDEVIN Machine Co. of Teterbore, N.J., and being well known to those in the bag-making industry, need not to be described in detail. Bag-making apparatus 12 is a POTDEVIN Model 835 self-opening bag-making machine modified as described hereinafter. Such machine has long been used in the bag-making industry and so its structure and operation are only described insofar as necessary to understand and use the present invention. As paper 14 is infed to machine 12 from imprinter 16, it first passes over a former 22. The former functions to form the flat sheet of incoming bag paper into a tube. Then, the bag paper enters the main section 23 of bag-making machine 12 where the tube is segmented and folded into bags. Referring to FIG. 2, former 22 comprises a plate member which is angled around a smooth curve to provide a horizontal downstream section 24 and an inclined upstream section 26. Section 24 is offset upwardly from outfeed roller 28 of the imprinter and section 26 is inclined downwardly at an obtuse angle toward the printer outfeed roller. The roll stand, printer and bag-making machine are aligned so that plate member 24, 26 is centered between the lengthwise edges of the sheet of paper 14. Thus, the former functions continuously to fold down opposite margins 30 of the incoming sheet of paper. The sheet then approaches main section 23 of machine 12 as a partially-formed tube. A pair of side plates (not shown) extend horizontally inward along plate section 24, one on each side, to fold margins 30 inwardly under plate 24 to form gussets or inwardly-folded side panels in the partially formed tube. A pair of rollers 25 underneath the former fold the margins of the sheet flat to form a lengthwise lap seam and thereby complete the tube as it enters the main section. Thereupon, the tubular sheet is subjected to a series of conventional operations ultimately to form it into self-opening bags, as further described hereinafter with reference to FIGS. 5–8.

Coupon-Applying Apparatus

The coupon-applying apparatus includes coupon strip infeeder 10, which is positioned upstream of roll stand 20, for infeeding a continuous coupon strip 32, and spacing means 11 affixed along the upper side of former plate 24, 26.

Figure 7:
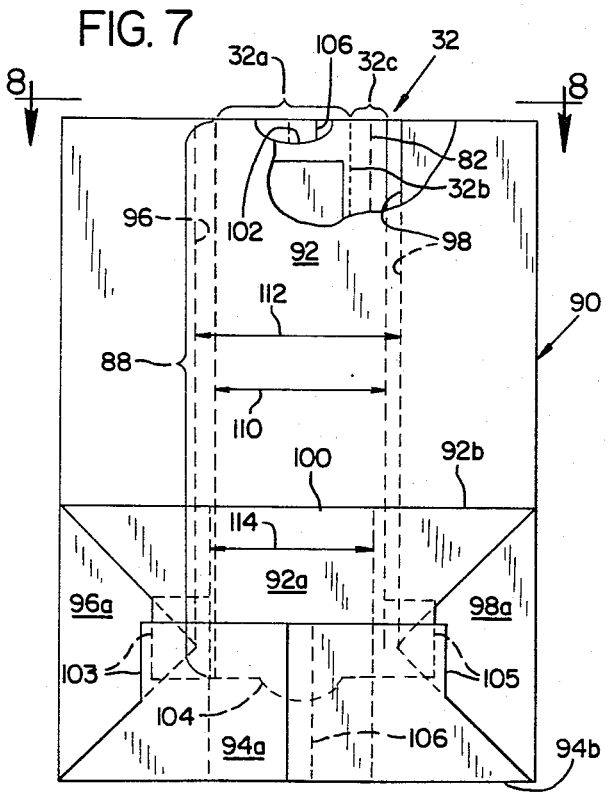
FIG. 7 is a front plan view of the self-opening grocery bag of FIG. 5, a portion of the front panel being cut away to show the coupon strip applied inside in accordance with the invention.
Figure 6:
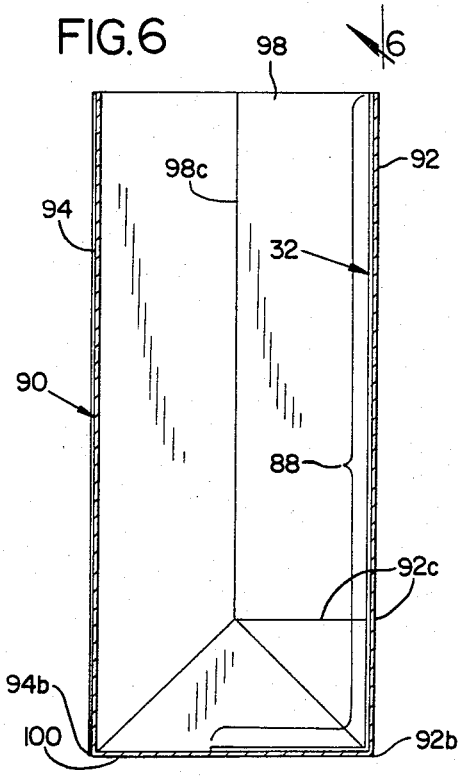
FIG. 6 is a vertical cross-sectional view taken along lines 6—6 in FIG. 5.

Referring to FIGS. 3, 6 and 7, a wide portion of the strip, coupon portion 32*a*, is imprinted to provide coupons. A line of perforations 32*b* extends lengthwise along one side of the strip to define a narrow marginal portion 32*c* of the coupon strip. The perforations enable main portions 32 to be separated from marginal portions 32*c*, which is glued to the bag. Optionally, transverse perforations are provided in the coupon portion of the strip. The strip is provided as a narrow continuous roll 34, which is supported on infeeder 10.

Referring to FIG. 2, spacing means 11 is provided on the former by two thin, elongated brass spacer strips 36, 38. These spacer strips support the sheet of bag paper as it travels along the upper side of the former so as to avoid applying undue pressure and possibly damaging the underlying coupon strip 32. The spacer strips are positioned lengthwise of the former plate and extend from the upstream end of the former plate along portion 26 and a short distance along portion 24 around the rounded angle between such portions. The spacer strips are spaced apart so that coupon strip 32 can pass between them with, for example, ½" clearance on each side. The spacer strips should be 0.020" to 0.035" thick and ideally are about 0.025" thick. A thickness less than 0.020", down to 0.005" more than the thickness of the coupon strip paper (e.g., 0.0020" to 0.003") would work but wears out quickly. A thickness over 0.035" begins to cut through the bag paper as it is pulled under tension along the former plate and a spacer strip thickness of 0.05" seriously weakens the bag paper.

Strip infeeder 10 comprises a rectilinear framework 40 having a coupon strip roll support rod 42 mounted horizontally along its upper rear side for supporting coupon strip roll 34. A pair of rollers 44, 46 are positioned one above the other at the lower front end of frame 40, parallel to the roll support rod 42, for guiding the continuous strip 32 of coupons from roll 34 around an S-curve before proceeding into the bag-making system. Infeeder 10 is centered behind roll stand 20, which is in turn centered with respect to the imprinter and former 22, so that the coupon strip is centered atop the former. A friction brake assembly 48 applies friction to roll 34 to maintain tension on coupon strip 32. The friction brake assembly includes a frame which comprises a pair of parallel elongated members 50, 52 mounted on a pivot rod 54 extending parallel to roll support 42. A counterbalance 56 is mounted on an arm 58 connected to one end of pivot rod 54. Rod 54 is positioned at the upper front corner of framework 40 and members 50, 52 extend rearwardly and upwardly above support 42. Arm 58 extends parallel to members 50, 52 in the opposite direction from members 50, 52 to counterbalance the weight of the brake assembly. A roller 60 is mounted on a rod 62 extending parallel to support 42 and rod 54 and is centered over roll 34 to support the frame on the roll. A side plate 64 mounted on rod 62 on one side of roller 60 maintains the coupon roll in a centered position. On the other side of the coupon roll is a pneumatic brake mechanism 66 which, when actuated, squeezes the roll against plate 64 to slow down its rotation and thereby tension coupon strip 32. Air pressure is provided to brake 66 through line 68. Line 68 is connected to a shutoff valve 70 connected to an air pressure source line 72. Valve 70 is used to release the brake for changing roll 34.

A glue applicator 74 is mounted above roller 44 on a rod 75 extending parallel to roller 44. Glue is supplied to the glue applicator via a conduit 76 from shutoff 70, to which glue is supplied via conduit 78. Referring to FIG. 3, the glue applicator has a nozzle 80 with about a ⅛" diameter orifice positioned nearly to contact roller 44 over marginal portion 32*c* of continuous strip 32.

During operation, the nozzle applies a narrows strip 82 of glue or adhesive to the upper side of the marginal portion of the coupon strip, as the strip is pulled over roller 44. Referring to FIG. 1, glue is pumped from a supply tank (not shown) via infeed conduit 83 through conduit 78 to applicator 74 by a metering pump 84 mounted on the main section of bag-making machine 12. The metering pump is driven by a pulley 85 connected to a rotationally driven element of the bag-making machine, such as slitter shaft 86. Rotation of the slitter shaft is proportional to rate of bag production and therefore controls the rate at which glue is metered to glue applicator 74. As the coupon strip and bag paper 14 come together along the underside of roller 21 of roll stand 20, tension on the coupon strip presses it against the underside of bag paper 14, so that the glue adheres marginal portion 32*c* to the bag paper. The coupon strip is then carried through printer 16 and bag-making machine 12 by paper 14 to make the combination of a bag and coupon strip as next described.

Grocery Bag With Coupon Strip

Referring to FIGS. 5, 6, 7, and 8, a segment 88 of coupon strip 32 is applied to a grocery bag 90, lengthwise along the inside of a front panel 92 of the bag. Bag 90 is a standard self-opening grocery bag having, in addition to front panel 92, a back panel 94, opposite side panels or gussets 96, 98, and a bottom panel 100. A thumb notch 102 is cut in the center of the front panel at the mouth of each bag. An arcuate flap 104 complementary to the thumb notch is formed inside the bottom panel 100 of each bag. Centered in the back panel 94 is a lap seam 106 which extends longitudinally from the mouth of the bag to the bottom panel.

In the bottom panel of the bag, lower end portions or tucks 96*a*, 98*a* of the side panels are folded inward toward the center of the bag. First and second tucks 92*a*, 94*a* formed by lower portions of the front and rear panels, respectively, are overlappingly folded toward one another along transverse creases 92*b*, 94*b* over tucks 96*a*, 98*a* to enclose the bottom of the bag. To enable folding tucks 92*a*, 94*a*, 96*a*, 98*a*, the bottom of the bag is slit along longitudinal lines 103, 105 and scored transversely along creases 92*b*, 94*b*. So that the bag can be folded flat, side panels 96, 98 are folded inwardly along creases 96*c*, 98*c* to form gussets. Front panel 92 is scored transversely along crease 92*c* to fold bottom panel 100 flat against the front panel of the bag.

Coupon segment 88 is centered widthwise inside the front panel of the bag. Such segment extends lengthwise from thumb notch 102 at the mouth of the bag lengthwise inside the front panel and across tuck 92*a* of bottom panel 100 to the end of flap 104. It is sized to a width 110 which is less than the spacing 112 between gussets formed by the inwardly-folded side panels 96, 98 of the bag when the bag is folded flat. In addition, the width of the main portion 32*a* of the coupon strip is no more than the spacing 114 between the edges of tucks 96*a*, 98*a*, so that the tucks do not overlap the main portion of the strip when the bottom of the bag is formed. The edge of tuck 98*a* can overlap margin portion 32*c*, as shown in FIG. 7. The reasons for the coupon strip being positioned as above described will become more readily apparent from the following description of the procedure for applying the strips during manufacture of the bags.

OPERATION

Referring to the lower portion of FIG. 1, during operation of bag machine 12, bag paper 14 is drawn continuously from roll 18 around bag stand outfeed roller 21 and forwardly in the direction of arrow 15. Coupon strip 32, adhered to the underside of paper 14, is likewise continuously drawn from roll 34. As the strip passes over coupon strip infeeder roller 44, applicator 74 applies glue strip 82 to marginal portion 32*c* of the coupon strip. Tension is maintained on roll 34 by brake assembly 48. As roll 34 gets smaller, assembly 48 pivots on rod 54 to maintain roller 60 against the roll. Tension imparted in strip 32 by brake 66 passes the strip upwardly against bag paper 14 as the strip and bag paper pass around the underside of roller 21. This action adheres the glue-smeared upper surface of margin portion 32*c* to the lower surface of paper 14.

Referring to the upper portion of FIG. 1, the bag paper and coupon strip travel together through printer 16, wherein the bag paper protects the coupon strip from damage and further printing. The bag paper and strip then travel upward around printer outfeed roller 28 to former 22. As the bag paper passes over the former, spacer means 11 supports the coupon so that it travels over plates 24, 26 without damage. The bag paper is then formed into a tube with strip 32 enclosed and protected inside the tube against damage during subsequent steps in the bag-making process.

Figure 5:
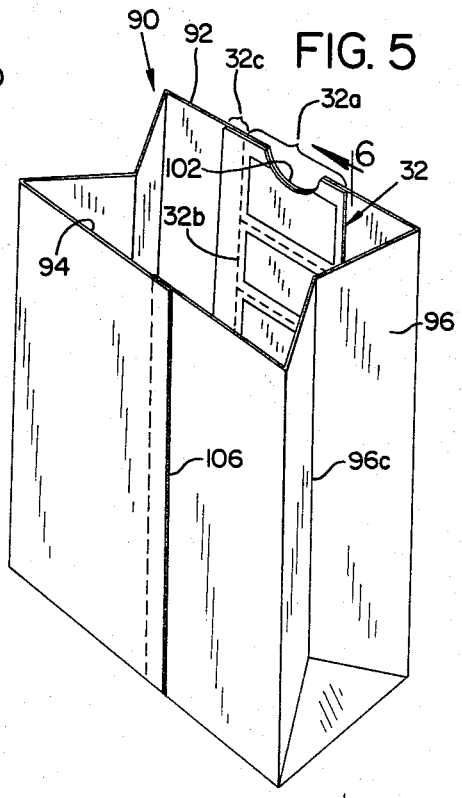
FIG. 5 is a perspective view of a self-opening paper bag with a coupon strip inside in accordance with the invention.
Figure 8:
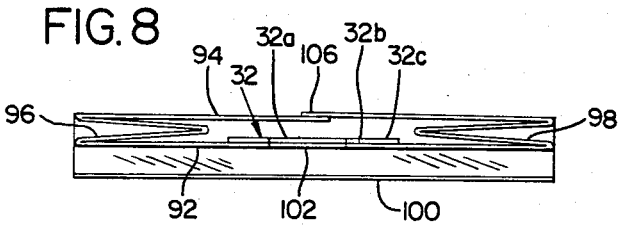
FIG. 8 is an end elevational view taken along lines 8—8 in FIG. 7.

Proceeding into the main section 23 of machine 12, the sheet passes successively through a slitter and lip knife 130, a scorer 132 and feed rollers 134. Feed rollers 134, 134*a* draw the bag paper through the machine. Slitter and lip knife 130 and scorer 132 are rotationally driven to slit and score the continuous sheet of paper at periodic intervals in a predetermined pattern corresponding to the length of each bag. Referring to FIGS. 5 and 7, these operations cut transverse thumb notch 102 in what will become the top edge of each bag, cut longitudinal slits 103, 105, and transversely score the paper along creases 92*b*, 92*c* and 94*b*, preparatory to forming the bottom of each bag. Besides cutting thumb notch 102 (and complementary flap 104 in the next succeeding bag), lip knife 130 also partially severs from the continuous coupon strip 32 a short length 88 of the coupons for each bag. As mentioned above, operation of slitter 130 on slitter shaft 86 controls the rate of discharge of glue from applicator 74.

Next, the tubular sheet of bag paper passes through a first cutoff and bottom-opening stage 136. There, an opening cylinder (not shown), driven synchronously with the foregoing elements, partially cuts the bag paper transversely into segments and completes severing the coupon strip into segments 88. From the first cutoff, the bag segments pass in turn through bottom shaper and bottom gluing stages 140. In these stages, the bottom portions 96*a*, 98*a* of each segment are folded inward and glue is applied to start forming the bottom panel 100 of each successive bag 90. Next, the bag segments pass through cutoff 142, at which first tuck 92*a* is cut off, finally separating the bag segments, and folded over bottom portions 96*a*, 98*a*. This step positions the lower end of coupon segment 88 in the bottom of the bag, between portions 96*a*, 98*a*, undamaged and with its main portion freely removable. In step 144, second tuck 94*a* is formed and then a pair of bottom folding wings (not shown) operate to fold the second tuck in the opposite direction over the first tuck. Finally, each bag passes out of the main section through delivery rollers 148, which press the bottom of the bag flat against the front panel 92 of the bag, and is discharged into a collector or bag tender (not shown). The bags are then interleaved, stacked, compressed and bound. Thereafter, the bundles are transferred to a packing station (not shown), where they are wrapped for shipping.

Having illustrated and described the principles of our invention in preferred and alternate embodiments thereof, it should be apparent to those skilled in the art that the invention may be modified in arrangement and detail without departing from such principles. Accordingly, we claim all modifications within the spirit and scope of the following claims.

We claim:

1. A method of applying a coupon strip to the inside of the front panel of a four-sided self-opening paper grocery bag having a front panel, a back panel, inwardly-folded opposite side panels joining the front and back panels, and a bottom panel closing the front, back and side panels, comprising:

conveying a continuous web of bag paper in the longitudinal direction thereof;

providing a continuous strip of coupons, the width of the strip being sized to a width less than the spacing between the inwardly-folded side panels of the bag when the bag is folded flat;

perforating the strip of coupons along a margin thereof, thus defining a margin portion and a detachable coupon portion, the width of the strip being further sized so that at least the detachable coupon portion is not overlapped by the ends of the side panels when the side panels are folded inwardly to form the bottom panel for the bag;

conveying the continuous strip of coupons longitudinally of the web of bag paper along one side thereof at a position spaced centrally of the longitudinal margins of the web of bag paper;

applying glue longitudinally solely to the margin portion of the strip of coupons on the side of the strip facing the web of bag paper;

pressing the margin portion and the coupon portion of the strip of coupons against the web of bag paper to adhere the margin portion to said one side of the web of bag paper prior to forming the web into a tube;

after adhering the margin portion of the strip of coupons to said one side of the web, continuously turning longitudinal margins of the web of bag paper with the strip of coupons adhered thereto toward said one side of the web to form the web into a tube and enclose the strip of coupons therein;

periodically cutting a portion of the web transversely to define a top of a first bag and a bottom of a second bag and to cut the strip of coupons into an elongated segment;

folding portions of the longitudinal margins of the bag inwardly to form inwardly-folded side panels of the bag; and folding the bottom of the bag to close the same.

2. The method of claim 1, further comprising supporting the web of bag paper with the adhered strip of coupons on the one side thereof without applying pressure to the strip of coupons while continuously turning the longitudinal margins of the web of bag paper toward said one side thereof to form the web into the tube, thereby to avoid damaging the strip of coupons.

* * * * *